United States Patent [19]

Devine

[11] 4,056,060

[45] Nov. 1, 1977

[54] ARMOR PLATE PENETRATOR

[75] Inventor: Patrick J. Devine, Cinnaminson, N.J.

[73] Assignee: The Government of the United States, as represented by the Secretary of the Army, Washington, D.C.

[21] Appl. No.: 776,342

[22] Filed: Mar. 10, 1977

Related U.S. Application Data

[62] Division of Ser. No. 660,526, Feb. 23, 1976, abandoned.

[51] Int. Cl.[2] ..... F42B 13/06

[52] U.S. Cl. ..... 102/52; 102/93

[58] Field of Search ..... 102/52, 93

[56] References Cited

U.S. PATENT DOCUMENTS

| | | | |
|---|---|---|---|
| 741,328 | 10/1903 | Groff | 102/52 |
| 1,503,769 | 8/1924 | Ryan | 102/52 |
| 3,277,825 | 10/1966 | Maillard | 102/52 X |
| 4,000,698 | 1/1977 | Corney | 102/93 |

*Primary Examiner*—Verlin R. Pendegrass

*Attorney, Agent, or Firm*—Nathan Edelberg; Robert P. Gibson

[57] ABSTRACT

Armor-piercing rounds having improved penetrators therein providing high axial moments of inertia, and hence, high gyroscopic stability which is attributable to the variously configured non-circular cross-sections of the penetrators.

5 Claims, 18 Drawing Figures

10
12
14
16
18
20
PRIOR ART 22
24
26
28
PRIOR ART 22
24
26
28
PRIOR ART

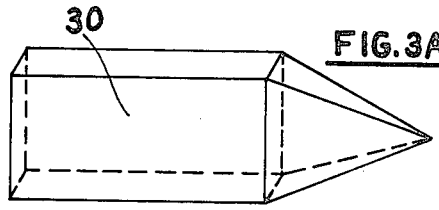
FIG. 3A
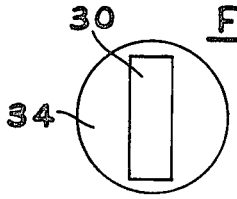
FIG. 3AA
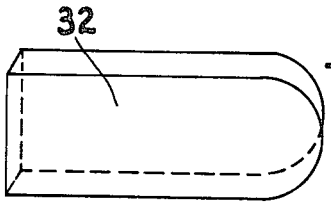
FIG. 3B
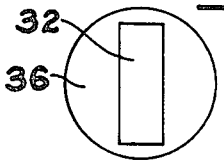
FIG. 3BB
FIG. 3C
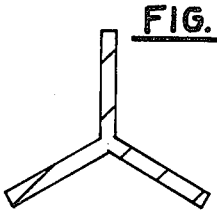
FIG. 3D
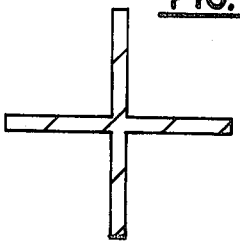
FIG. 3E
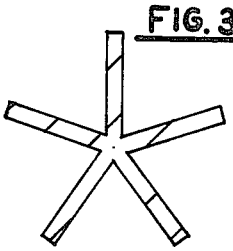
FIG. 3F
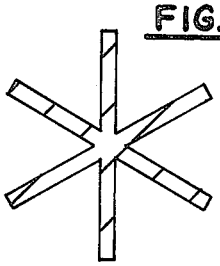

ARMOR PLATE PENETRATOR

The invention described herein may be manufactured, used and licensed by or for the Government for governmental purposes without the payment to me of any royalty thereon.

This is a division of application Ser. No. 660,526, filed Feb. 23, 1976, and now abandoned.

This invention relates to ammunition and more particularly concerns an armor-piercing round having a core or penetrator therein of improved design to provide good gyroscopic stability to the round.

Battlefield targets may be classified broadly into three types: Soft Targets, such as personnel and trucks; Lightly Armored Vehicles, such as personnel carriers; and Hard Targets, such as tanks and the like.

A generic approach to a multi-capability ammunition/weapon system which would prove effective against any of the aforementioned targets would involve a system capable of actually firing two different types of ammunition, i.e., a high explosive (HE) round against soft targets, and armor-piercing (AP) rounds against hard targets. In the design of such a system, performance trade-offs would be required because of inherent differences in the rounds. As an example, the AP round depends upon the kinetic energy of its projectile as its defeat mechanism, i.e., the higher the mass and velocity, the greater will be the terminal effects on the target. The HE round, on the other hand, depends primarily on the potential energy of its explosive and the probability that the fuze-explosive train will function upon impact at the target.

For many reasons, it is more difficult to stabilize an AP round than an HE round. Thus, an AP round has a high density core which provides a low axial moment of inertia and a high transverse moment of inertia, necessitating a high twist barrel for proper stabilization of the round. Such a high twist would be detrimental to any HE round in a multi-capability ammunition/weapon system since overstabilization would prevent the round from nosing over in flight and remaining tangential to the trajectory and resulting in the round picking up a yaw angle. As a result, the projectile would not always impact on its nose, thus yielding a higher dud rate. Further, the high angular acceleration caused by this high twist barrel would pose severe design problems for the fuze mechanism of the HE round.

But perhaps the most serious drawback in any possible multi-capability system would be the compromises made to the AP component. In any AP round, the length of the penetrator, as well as the velocity of the round, would substantially dictate terminal performance of the round. Shortening the penetrator to make it more compatible with the HE round would degrade the terminal performance of this round in any AP-HE system in an anti-armor role.

It is accordingly an object of this invention to provide an AP round with improved gyroscopic stability, the round including a non-discarding sabot.

Another object of the invention is to provide such a round by altering the transverse cross-section of the penetrator component contained within the round.

Still another object of the invention is to provide such a round having an altered penetrator cross-section wherein the axial moment of inertia of the altered penetrator is increased to thus provide greater gyroscopic stability of the round.

A still further object of the invention is to provide such a penetrator as aforedescribed, the altered penetrator having a center of gravity and weight substantially identical with the existing penetrator and requiring no alteration of the exterior design of the round.

The exact nature of the invention as well as other objects and advantages thereof will be readily apparent from consideration of the following specification relating to the annexed drawings wherein.

Figure 3G:
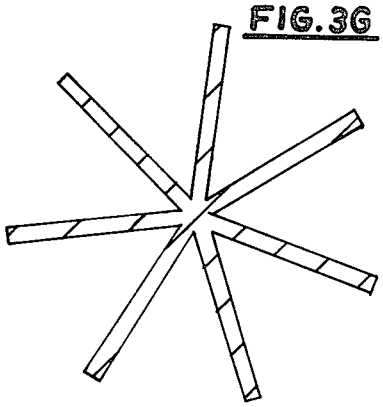
FIGS. 3A and 3B are isometric views of substantially rectangular penetrators.
Figure 3H:
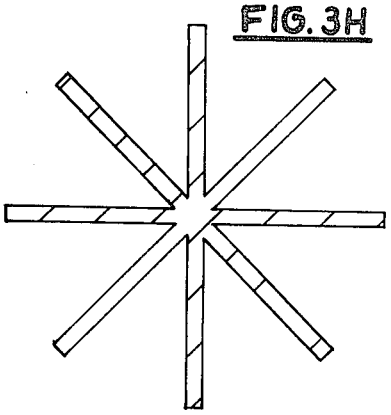

FIGS. 3AA and 3BB indicate the relative cross-sectional areas of the penetrators and sabots and the axial alignments of the penetrators within the sabots.

Figure 2A:
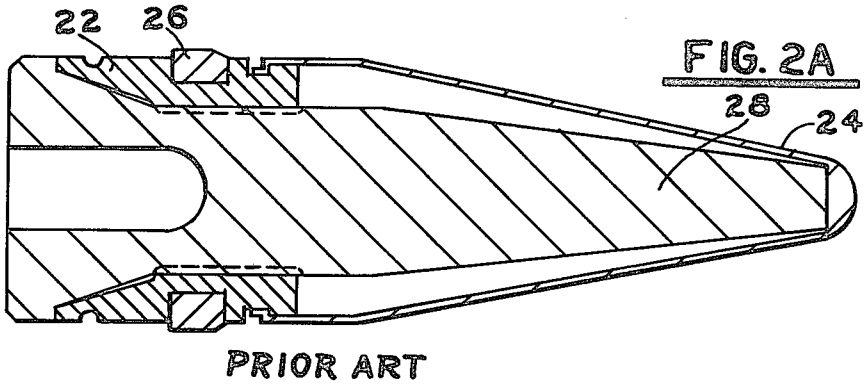
FIGS. 2A and 2B are enlarged views of standard designs of the projectile 20 of FIG. 1.
Figure 2B:
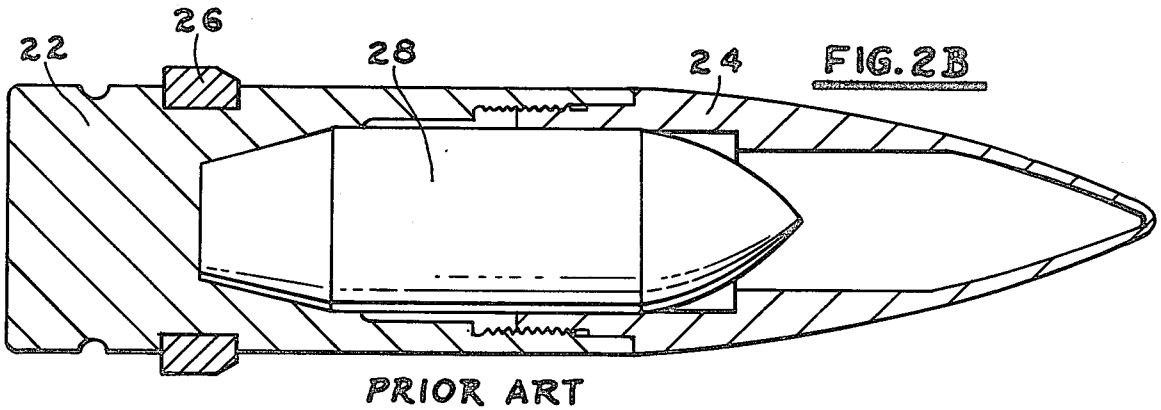

FIGS. 3C–3H are transverse sectional views of modifications of plate penetrators of my invention for use in projectiles exemplified by the drawings of FIGS. 2A and 2B.

Figure 4:
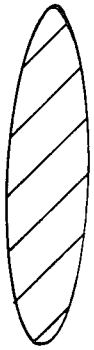

FIG. 4 illustrates an additional modification of a penetrator, wherein its transverse cross-section is elliptical.

Figure 5:
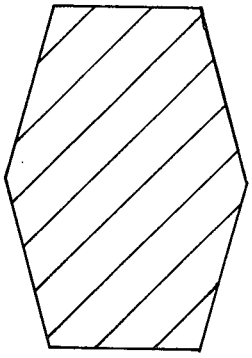

FIG. 5 shows a transverse sectional view of an hexagonal type penetrator.

Figure 6:
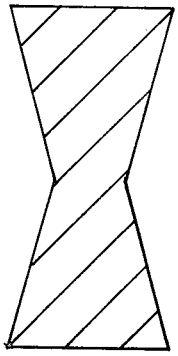

FIG. 6 illustrates yet another modification of a penetrator which resembles superposed trapezoids.

Figure 7:
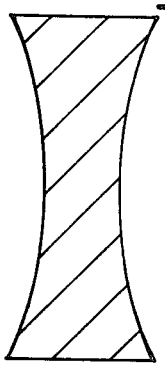
Figure 8:
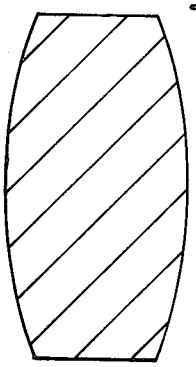

FIGS. 7 and 8 are still further illustrations of modified penetrators having arc segments or curves delineating the cross-sections thereof.

Figure 1:
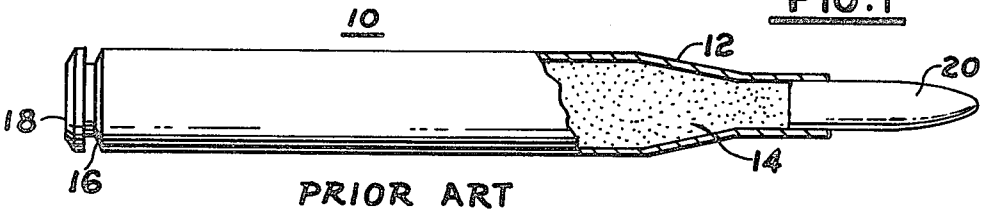
FIG. 1 shows a partially cutaway view of a conventional 20mm cartridge.

Referring now to FIG. 1 of the drawings, there is shown a standard or conventional 20mm cartridge 10 having case wall 12, propellant 14, extracting groove 16, and head 18. The projectile 20 is similarly of conventional design and may assume any one of several variations, such as those shown in FIGS. 2A and 2B. A sabot 22, conveniently of aluminum, has a cap or windshield 24. A rotating band 26 is carried in the sabot in the usual manner. Core or penetrator 28, made of a high density material, such for example, as depleted uranium, tungsten alloy, and the like, is axially disposed within the projectile. Core 28 is modified in accordance with FIGS. 3–8, which are representative of the invention herein claimed.

In the modifications of FIGS. 3A and 3B, the penetrators are basically rectangular in shape and configuration. A tapered penetrator 30 is depicted in FIG. 3A whereas FIG. 3B illustrates a hemispherical penetrator 32. It will be understood that the penetrators of FIGS. 3A and 3B, as well as all modifications of penetrators to be hereinafter described, will be axially aligned within the projectile and will comprise substantially the same weight as the core or penetrator it replaces of standard or conventional design. In the modifications of FIGS. 3A and 3B abovedescribed, the non-discarding sabots 34 and 36 respectively will necessarily be adapted to receive the rectangularly configured penetrators, which adaption is well within the skill of the art. It will be further understood that the center of gravity of my modified penetrators will coincide with the center of gravity of the existing penetrators.

A comparison of the axial moments of inertia of rectangularly cross-sectioned penetrators versus the prior art circular cross-sectioned penetrators is shown in Table I below:

TABLE I

COMPARISON OF AXIAL MOMENTS OF INERTIA OF RECTANGLES AND CIRCLES HAVING IDENTICAL CROSS-SECTIONAL AREAS.

| Rectangle Dimensions | | Axial Moments of Inertia | |
|---|---|---|---|
| Length | Width | Rectangle | Circle |
| 1.0 | 1.0 | 1.0472 | 1.0 |
| 1.5 | 1.0 | 1.1344 | 1.0 |
| 2.0 | 1.0 | 1.3089 | 1.0 |
| 2.5 | 1.0 | 1.5184 | 1.0 |
| 3.0 | 1.0 | 1.7453 | 1.0 |
| 3.5 | 1.0 | 1.9822 | 1.0 |
| 4.0 | 1.0 | 2.2252 | 1.0 |
| 4.5 | 1.0 | 2.4725 | 1.0 |
| 5.0 | 1.0 | 2.7226 | 1.0 |

The above moments may be calculated thus:

Rectangular plate: 1/12 M (length$^2$ + width$^2$), and

Circular plate: $\frac{1}{2}$ MR$^2$, where M designates mass and R designates radius. The cross-sections of the rectangular and circular penetrators of Table I have equal masses. The importance of the axial moment becomes apparent when it is realized that gyroscopic stability varies directly as the square of the axial moment of inertia, i.e., $$\frac{S_g = I_x^2 p^2}{4I_y} \quad \frac{I_x^2 p^2}{4I_y}$$

Where $S_g$ = gyroscopic stability $I_x$ = axial moment of inertia (slug-ft2)

$I_y$ = transverse moment of inertia (slug-ft2)

$p$ = axial angular velocity (radians/sec) = static moment factor (lb-ft/radian)

From the above Table, it is apparent that rectangulr penetrators should have high length to width ratios for good gyroscopic stability, from an exterior ballistics point of view. This ratio however must be compatible with the exterior boundary geometry of the projectile.

The modification of FIG. 3C employs a 3-plate penetrator. By increasing the number of plates, variation of the interior, exterior, and terminal ballistics will be minimized. Thus, the modification shown in FIG. 3C may be considered to have three rectangular plates, each being equal to each other in every respect and separated from each other by 120°. The gyroscopic stability of the 3-plate penetrator is superior to the prior art circular cross-sectioned penetrator for reasons abovementioned.

FIGS. 3D thru 3H illustrate four-plate thru eight-plate penetrators. Again, the gyroscopic stability of each will be superior to the prior art circular cross-sectioned penetrators. The individual plates comprising each modification are equal to each other in every respect for any given modification, and will be separated from each other, for any given modification by an equal number of degrees. By merely varying and controlling plate thicknesses for any of the modifications, total weight and center of gravity of the modified penetrator will coincide with the center of gravity and weight of the existing core of the standard projectile.

Further, my plate penetrators may assume the profiles of the penetrators shown in FIGS. 2A or 2B merely by tapering, or shaping, to closely configure the ogive of the projectile. As aforedescribed, not only will the weight of my penetrators coincide with the existing core weight, but the center of gravity of my penetrators will coincide with the center of gravity of the existing penetrator if the individual plates of the respective modifications are spaced equidistant from each other and are fabricated to the proper thicknesses, all of which is within the skill of the art.

In the modifications of FIGS. 4 and 5, the mass closer to the axis of rotation of the penetrators in greater than the mass at points removed therefrom, resulting in an increase in projectile shatter velocity. Higher axial moments of inertia, and hence better gyroscopic stability of the projectile will also be achieved with these elliptical hexagonal penetrators as compared to circular penetrators of the prior art.

Referring to the elliptical penetrator of FIG. 4, the major axis thereof cannot equal the minor axis, lest a circular penetrator be formed. In the hexagonal modification (FIG. 5), the dimension "*a*" will exceed the dimension "*b*".

A comparison of the axial moments of inertia of elliptical cross-sectioned penetrators versus the prior art circular cross-sectioned penetrators is shown in Table II below:

TABLE II

COMPARISON OF AXIAL MOMENTS OF INERTIA OF ELLIPSES AND CIRCLES HAVING IDENTICAL CROSS-SECTIONAL AREAS.

| Radius of Circle | Axial Moment of Circle | Length of Major Axis of Ellipse | Axial Moment of Ellipse |
|---|---|---|---|
| 1.0 | 1.0 | 1.0 | 1.000 |
| 1.0 | 1.0 | 1.5 | 1.347 |
| 1.0 | 1.0 | 2.0 | 2.125 |
| 1.0 | 1.0 | 2.5 | 3.205 |
| 1.0 | 1.0 | 3.0 | 4.555 |
| 1.0 | 1.0 | 3.5 | 6.166 |
| 1.0 | 1.0 | 4.0 | 8.031 |
| 1.0 | 1.0 | 4.5 | 10.150 |
| 1.0 | 1.0 | 5.0 | 12.520 |

As with rectangles aforedescribed, or with any of the other modifications of penetrators to be hereinafter described, the ratio of parameters providing good axial moments must still be compatible with projectile geometry.

FIG. 6 illustrates yet another modification of a penetrator wherein good gyroscopic stability will be provided. More of the penetrator mass is located farther from the axis of rotation of this penetrator than those modifications depicted in either FIGS. 4 or 5. The configuration of the penetrator of FIG. 6 appears to comprise two trapezoids, one superposed above the other, the shortest face of each being in abutting relationship. This piece, of course, is readily fabricable by means well known.

Variations of the above described modifications may be used advantageously. For example, the penetrator of FIG. 7 may be considered an extension of the trapezoid modification, but utilizes arc segments in lieu of the straight line segments of the trapezoid modification.

Similarly, the penetrator of FIG. 8 may be considered an extension of the hexagonal penetrator depicted in FIG. 5 of the drawings. The FIGS. 7 and 8 modifications provide axial moments of inertia superior to the prior art circular cross-sectioned core or penetrator. The modified penetrators of FIGS. 4–8 may readily be fabricated by procedures well known such that their centers of gravity and weights will be substantially identical to the existing penetrators.

For ease of fabrication, rounded edges may be provided on the ends or the plates of the plate penetrator modificatons, as well as the central portions thereof, and a small radius may be permitted at the axis of rotation, or where the trapezoids appear to meet, in the penetrator of FIG. 6.

It is apparent from the foregoing description that I have provided rounds or cartridges up to 40mm in size, and even larger, with uniquely configured cores or penetrators which provide the projectiles containing these penetrators with improved gyroscopic stability, having substantially identical centers of gravity and weights as the existing cores or penetrators, and requiring no alteration of the exterior design of the cartridge.

I wish it to be understood that I do not desire to be limited to the exact details of construction shown and described, for obvious additional modifications will occur to a person skilled in the art.

I claim:

1. In an armor piercing round having a case wall including propellant therewithin and a projectile disposed at a forward portion of said case wall, said projectile including a penetrator or core therewithin, said projectile being carried by a non-discarding sabot, said sabot having a windshield associated therewith, and means for igniting said propellant within said case for propelling said projectile forwardly with said sabot and windshield form said case at a high rotational speed, in combination therewith, the improvement comprising said penetrator having a non-circular transverse cross-section throughout its length and a predetermined center of gravity and weight, said non-discarding sabot having an internal configuration mating generally with the exterior configuration of said non-circular transverse cross-section penetrator, and said non-circular transverse cross-section penetrator having an axis and comprising a plurality of plates, each of said plates extending from said axis and being equal to each other and spaced from each other by an equal number of degrees.

2. The device of claim 1 wherein said penetrator comprises three plates.

3. The device of claim 1 wherein said penetrator comprises four plates.

4. The device of claim 1 wherein said penetrator comprises six plates.

5. The device of claim 1 wherein said penetrator comprises eight plates.

* * * * *